US007757313B2

(12) United States Patent
Koorey

(10) Patent No.: US 7,757,313 B2
(45) Date of Patent: Jul. 20, 2010

(54) BED LIFTING SYSTEM

(76) Inventor: John Koorey, 36 Bower Street, Manly, New South Wales (AU) 2095

( * ) Notice: Subject to any disclaimer, the term of this patent is extended or adjusted under 35 U.S.C. 154(b) by 425 days.

(21) Appl. No.: 11/631,217

(22) PCT Filed: Dec. 16, 2005

(86) PCT No.: PCT/AU2005/001906

§ 371 (c)(1),
(2), (4) Date: Dec. 28, 2006

(87) PCT Pub. No.: WO2006/063410

PCT Pub. Date: Jun. 22, 2006

(65) Prior Publication Data

US 2008/0289112 A1 Nov. 27, 2008

(30) Foreign Application Priority Data

Dec. 17, 2004 (AU) ..... 2004907189

(51) Int. Cl.
*A61G 7/012* (2006.01)

(52) U.S. Cl. ..... 5/11; 5/488

(58) Field of Classification Search ..... 5/11, 5/611, 488, 509.1, 510, 616
See application file for complete search history.

(56) References Cited

U.S. PATENT DOCUMENTS

| | | | | |
|---|---|---|---|---|
| 3,887,950 | A * | 6/1975 | Wachsman | 5/11 |
| 4,381,571 | A | 5/1983 | Elliott | |
| 5,490,297 | A | 2/1996 | Bradcovich et al. | |
| 5,490,298 | A * | 2/1996 | Goldsmith et al. | 5/611 |
| 5,758,372 | A * | 6/1998 | Lopez Diaz | 5/200.1 |
| 6,637,056 | B1 | 10/2003 | Tybinkowski et al. | |
| 2005/0251915 | A1 * | 11/2005 | Elizondo | 5/611 |
| 2007/0283494 | A1 * | 12/2007 | Vasey | 5/488 |

FOREIGN PATENT DOCUMENTS

| | | |
|---|---|---|
| AU | 199897236 | 7/1999 |
| CA | 2045308 A | 12/1992 |
| DE | 4406784 C1 | 8/1995 |
| DE | 19854136 | 6/1999 |
| EP | 0558108 A2 | 9/1993 |
| EP | 0999533 A2 | 5/2000 |
| EP | 1281659 | 2/2003 |

(Continued)

OTHER PUBLICATIONS

Derwent Abstract Accession No. 97-343627/32, DE 29706683U1, Jul. 3, 1997, Casa-Garden GmbH & Co KG REHA-Produkte Fur Die Pflege.

(Continued)

*Primary Examiner*—Michael Trettel
(74) *Attorney, Agent, or Firm*—Ballard Spahr LLP

(57) ABSTRACT

A bed lifting system for lifting a bed comprises a bed lifting mechanism and a switch remotely located from the bed lifting mechanism. The switch is adapted to enable selective and remote actuation of the bed lifting mechanism. The mechanism can be provided in kit form through the use of frame connectors which can also improve the interconnection and interoperability of frame members of the mechanism. The mechanism may also comprise adjustable lands to accommodate varying bed types.

17 Claims, 14 Drawing Sheets

FOREIGN PATENT DOCUMENTS

| | | | |
|---|---|---|---|
| FR | 2659227 | A | 9/1991 |
| FR | 2674415 | | 2/1992 |
| FR | 2798053 | | 3/2001 |
| GB | 2360940 | | 10/2001 |
| JP | 10-23944 | | 1/1989 |
| NL | 9401725 | | 3/1996 |
| WO | WO 94/08543 | A1 | 4/1994 |
| WO | WO 99/060893 | A2 | 12/1999 |
| WO | WO 01/045626 | A1 | 6/2001 |

OTHER PUBLICATIONS

Derwent Abstract Accession No. 97-506835/47<JP 09238986, Sep. 16, 1997, Paramount Bed KK.

Derwent Accession No. 98-474775/41, Aug. 4, 1998, Paramount Bed KK.

Derwent Abstract Accession No. 1999-564736/48 JP11244341 A, Sep. 14, 1999, Paramount Bed KK.

* cited by examiner

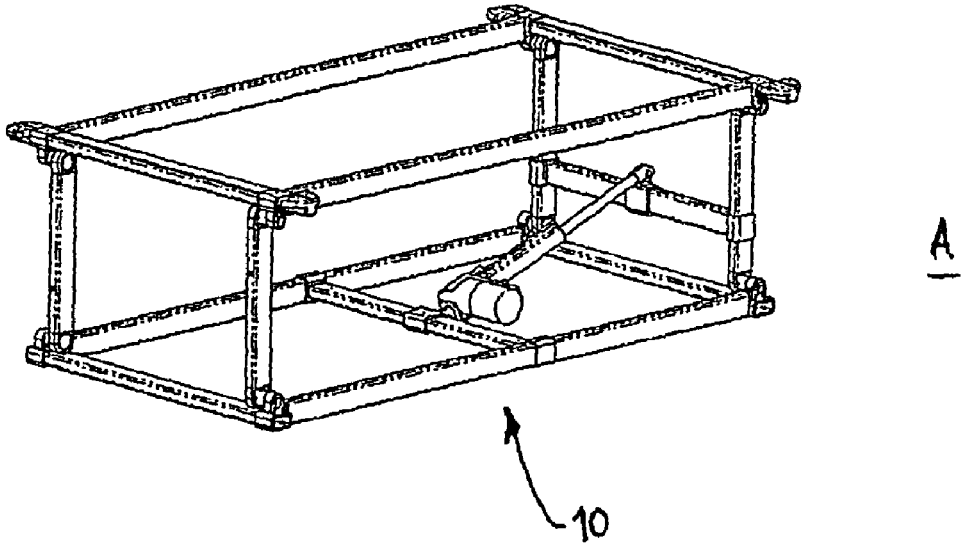
FIG. 6
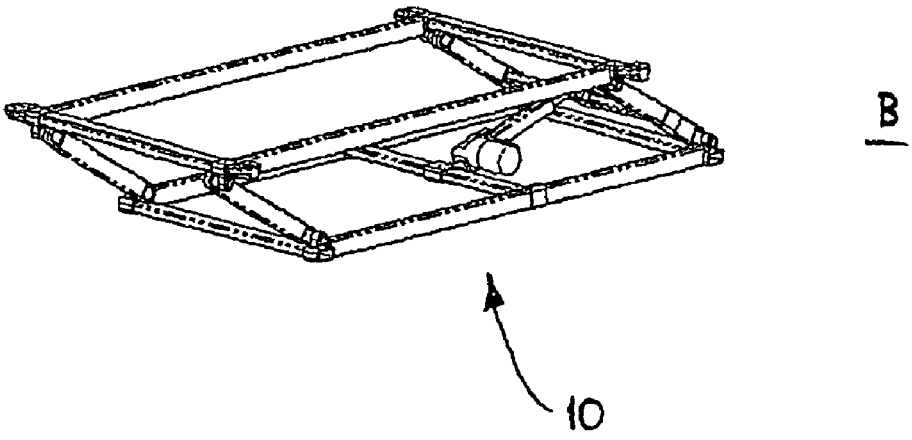

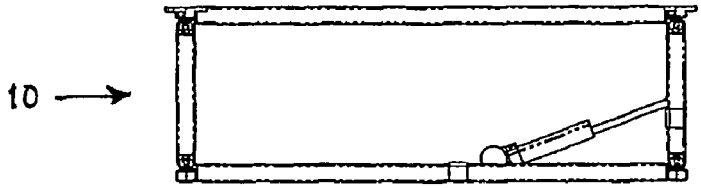
A
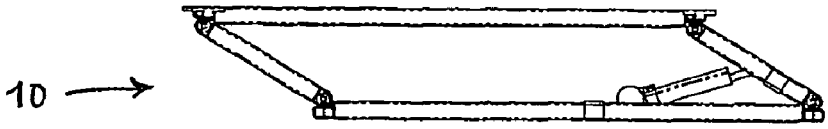
B
FIG. 7
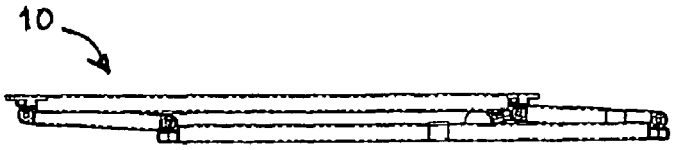
C

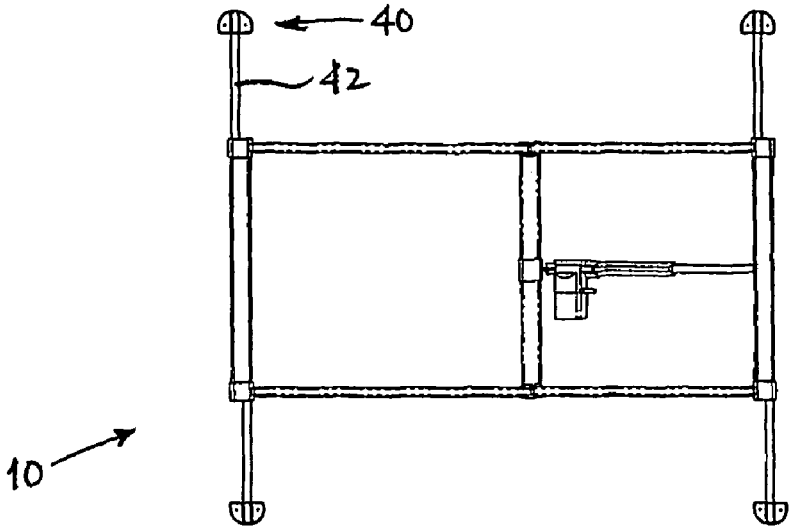
A
FIG. 8
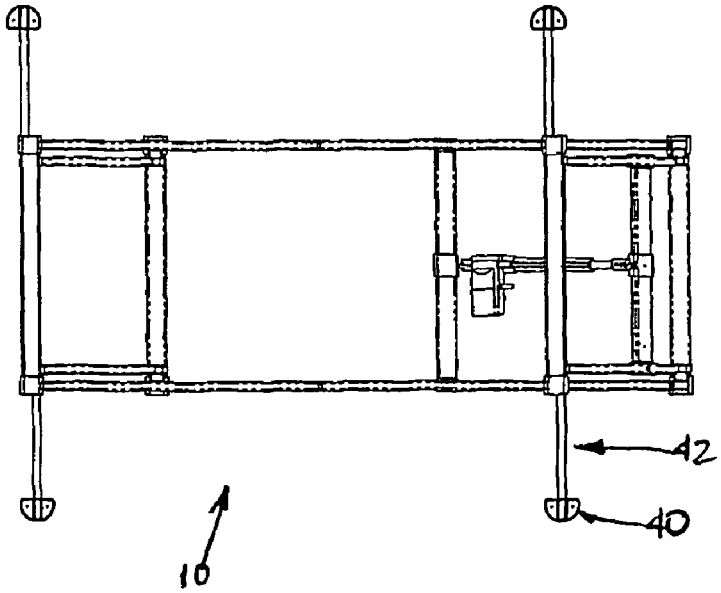
B

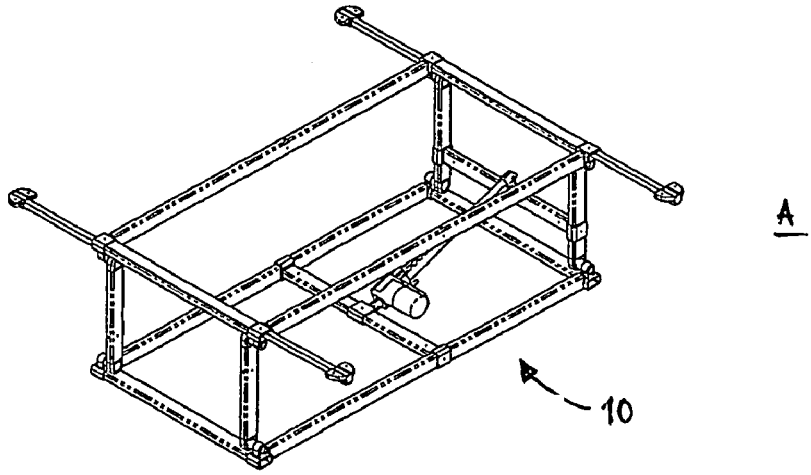
A
FIG. 9
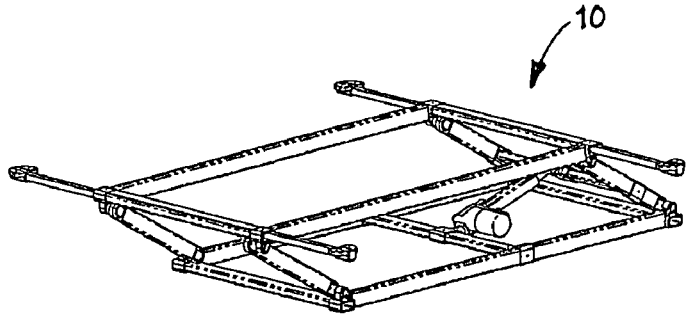
B
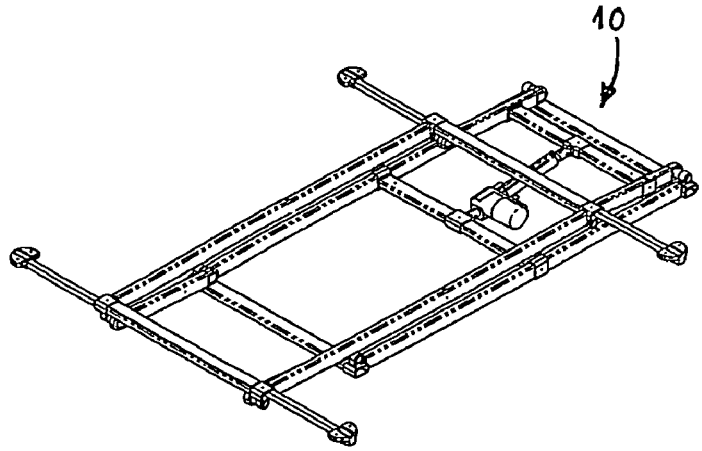
C

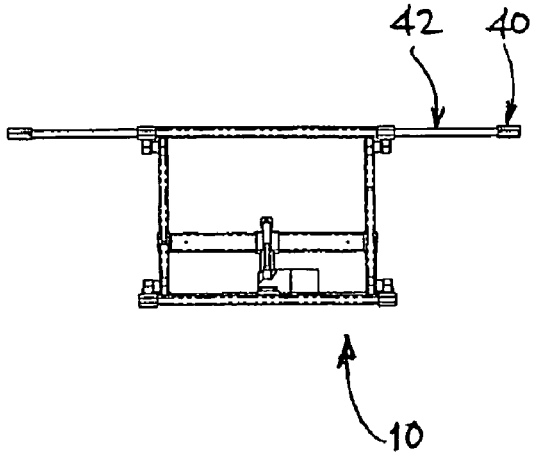
A
FIG. 10
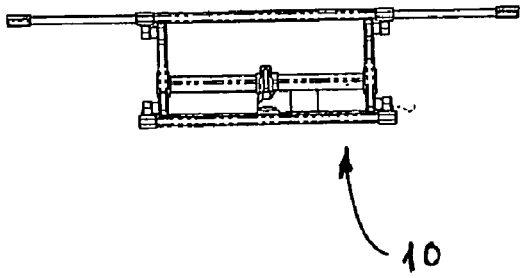
B
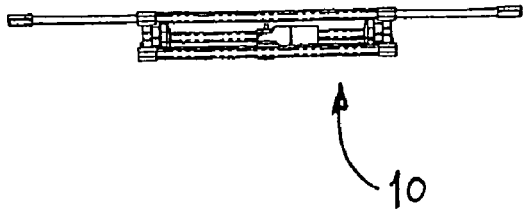
C

BED LIFTING SYSTEM

TECHNICAL FIELD

A bed lifting system is disclosed that facilitates easy lifting of a bed. The bed lifting system finds particular though not exclusive application in commercial and domestic contexts.

BACKGROUND ART

When making a bed, typically a user must bend over, because standard bed heights are lower than the waist height of most users. In addition, beds that abut one or more walls (or other surface—eg. bedhead) can be harder and more cumbersome to make. Such problems become more acute in a commercial context (eg. in hotels and the like) where many beds must be made in a short time frame.

Examples of bed lifting apparatus are known in the art. Examples are shown in FR 2674415, AU 199897236, EP 1281659, JP 10-23944, NL 9401725 and FR 2798053. However, the known configurations of the art tend to be bulky, heavy and/or cumbersome, and not easy to use, especially in commercial applications.

SUMMARY

In a first aspect there is provided a bed lifting system for lifting a bed, the system comprising:

a bed lifting mechanism; and a switch remotely located from the bed lifting mechanism, the switch being adapted to enable selective and remote actuation of the bed lifting mechanism.

Particularly, though not exclusively, in commercial applications, the location of a switch remotely from the bed lifting mechanism enables a user to enter a room in which the bed to be lifted is located, activate the switch and then rapidly make/strip/turn etc the bed. Thereafter the user can re-activate the switch to lower the bed back in place.

In one embodiment the switch may switch form part of:

a keypad that is positionable on a wall of a room in which the bed to be lifted is located; or a hand-held remote controller that can be accessed on entry to a room in which the bed to be lifted is located.

Thus, a user may enter a room, engage the keypad or controller, cause the bed to be lifted and then may access (eg. to make/strip/turn etc) the bed. Thereafter the user can re-engage the keypad or controller to lower the bed.

For security, the keypad may be key-activated with a physical key and/or may have alpha- and/or numeric-touch pads, together with an activation code, to activate the keypad, and thus selectively actuate the bed lifting mechanism. Again, for security, the controller may comprise alpha- and/or numeric-touch pads, together with an activation or security code.

In a further alternative, the switch may form part of a closed electrical circuit connected to the bed lifting mechanism, to selectively switch open and close the circuit.

The remote controller may operate via emf radiation (such as infra-red radiation) to activate the bed lifting mechanism, with the controller activating a receiver that forms part of an electrical circuit connected to the bed lifting mechanism.

In one form the bed lifting mechanism comprises:

a base for location on a floor;

a support for location at and engagement with an underside of the bed; and an actuator for operation between the base and support to move the support away from or towards the base and thereby raise or lower the bed.

The bed lifting mechanism may be adapted to lift a bed to a height such that, when making the bed, a user does not need to bend over, at least to any significant extent. This can help preserve a user's posture and back strength. This can be highly advantageous in a commercial context (eg. in hotels, where service staff must make many beds in a short time). Optimally, the bed lifting mechanism is configured to lift the bed to a waist height of most average users.

Additionally, the bed lifting mechanism may be configured such that, during bed raising, the bed is also lifted laterally away from and out of abutment with one or more walls (or other surfaces) such that a user may then be able to access that side of the bed, allowing for easier and faster bed making.

The actuator can comprise a pantographic linkage extending between and pivotally coupled to each of the base and support for moving the support towards or away from the base, but also so as to enable lateral shifting of the support with respect to the base (ie. to enable a bed to moved away from a wall or the like).

Alternatively, the actuator may simply comprise a straight lifting mechanism (eg. one or more rams driven by an electrical (eg. stepper) motor or driven hydraulically).

In one form the pantographic linkage is actuated to be moved by a ram. The ram may be driven by an electrical (eg. stepper) motor or hydraulically (eg. via a hydraulic drive/motor).

The ram and its drive can be mounted to extend between the base and one or more links in the pantographic linkage. For example, a free end of the ram can be pivotally coupled to a member that laterally extends from and between two opposing linkage arms of the pantographic linkage of the actuator. At an opposite end of the ram (and eg. via its corresponding drive) there can also be provided a pivotal coupling to a lateral member that extends from and between two opposing frame members of the base.

Each of the support and base can comprise a rectangular frame having a dimension that corresponds to a width and length dimension less than that of the bed to be lifted but of sufficient dimension to stably raise and lower the bed. The frames may each comprise a plurality of members of hollow or channel section, to minimise weight of the bed lifting mechanism but to preserve its structural integrity.

The support may also be provided with a plurality of discrete and spaced-apart lands on which the bed underside may rest and be supported in use. The location of the lands may be adjustable. For example, each land may be connected to a respective arm that is slidably mounted with respect to the support for lateral movement with respect to the support.

In a second aspect there is provided a bed lifting mechanism that comprises:

a base for location on a floor;

a support for location at and engagement with an underside of, or for incorporation into, the bed; and an actuator for operation between the base and support to move the support away from or towards the base and thereby raise or lower the bed;

wherein each of the base, support and actuator are releasably attached to each other such that the mechanism can be supplied as or deconstructed into a kit form.

The capacity of the bed lifting mechanism to be supplied in kit form is of particular commercial benefit, as it enables a commercial establishment (eg. hotel) to purchase multiple mechanisms that occupy a more confined volume, and to then easily store and then retrofit these to beds as necessary. It also makes for easy servicing and parts replacement.

The releasable attachment between the base, support and actuator can readily be facilitated by employing hollow or channel elongate members in a frame-like construction for each of the base, support and actuator, and by employing push-in connectors that push into or onto respective ends of the hollow or channel elongate members in a friction or interference fit. The connectors may then extend between and connect together the hollow or channel elongate members.

The bed lifting mechanism may otherwise be defined as in the first aspect.

In a third aspect there is provided a bed lifting mechanism that comprises:

a base for location on a floor, the base comprising a frame formed from a plurality of interconnected elongate members;

a support for location at and engagement with an underside of the bed, the support also comprising a frame formed from a plurality of interconnected elongate members; and an actuator for operation between the base and support to move the support away from or towards the base and thereby raise or lower the bed, the actuator also comprising a plurality of elongate members, and with each actuator elongate member extending between the base and the support;

wherein each actuator elongate member is pivotally mounted at a respective end to either the base or support via a connector that also interconnects two elongate members in the base or support frame respectively.

This connector configuration can greatly simplify the construction/dismantling and servicing of the bed lifting mechanism (especially with respect to a kit form in a commercial context).

In the third aspect, each of the base and support frames can be rectangular and can each comprise four elongate members. Each connector can then interconnect two elongate members in the base or support frame at a respective corner of each frame.

Further, each connector can be configured such that, as the support moves away from or towards the base, each actuator elongate member pivots in a manner whereby it does not align with any elongate member in either the support or base. This configuration can eliminate the formation of pinch points in use of the mechanism, which can otherwise be dangerous to the unsuspecting user of the mechanism.

Again, the bed lifting mechanism may otherwise be defined as in the first and second aspects.

In a fourth aspect there is provided a connector as defined in the second and third aspects.

In a fifth aspect there is provided a bed that incorporates a bed lifting mechanism as defined in the first aspect, but wherein the support is built into or forms a part of a framework of the bed itself.

In this aspect, there is no need to separately supply the bed lifting mechanism.

Also, in this bed, the bed lifting mechanism may otherwise be defined as in the first, second and third aspects.

In a fifth aspect there is provided a bed lifting mechanism comprising:

a base for location on a floor;

a support for location at and engagement with an underside of the bed; and an actuator for operation between the base and support to move the support away from or towards the base and thereby raise or lower the bed;

wherein the support is provided with a plurality of discrete and spaced-apart lands on which the bed underside can rest and be supported in use, with the position of each land being adjustable.

The use of adjustable lands enables the bed lifting mechanism to be used with and to support a number of different bed sizes and types.

Each land can be connected to a respective arm that is slidably mounted with respect to the support for lateral movement with respect to the support. Thus each land can be independently adjusted for the particular bed type with which it is used (eg. single, double, queen, king etc).

Again, the bed lifting mechanism may otherwise be defined as in the first, second and third aspects.

BRIEF DESCRIPTION OF THE DRAWINGS

Notwithstanding any other forms that may fall within the scope of the bed lifting system and mechanism as defined in the Summary, specific embodiments of the bed lifting system and mechanism will now be described, by way of example only, with reference to the accompanying drawings in which:

FIGS. 6A and 6B respectively show perspective views of the bed hoist of FIG. 1 in an erect configuration and a partially collapsed (midway) configuration;

FIGS. 7A to 7C respectively show side views of the bed hoist of FIG. 1 in an erect configuration, a partially collapsed (midway) configuration and a fully collapsed configuration;

FIGS. 8A and 8B respectively show plan views of the bed hoist of FIG. 1 in an erect configuration and a partially collapsed (midway) configuration, with both configurations showing support arms extended;

FIGS. 9A to 9C respectively show perspective views of the bed hoist of FIG. 1 in an erect configuration, a partially collapsed (midway) configuration and a fully collapsed configuration, with all configurations showing the support arms extended;

FIGS. 10A to 10C respectively show end views of the bed hoist of FIG. 1 in an erect configuration, a partially collapsed (midway) configuration and a fully collapsed configuration, with all configurations showing the support arms extended;

DETAILED DESCRIPTION OF SPECIFIC EMBODIMENTS

Figure 1:
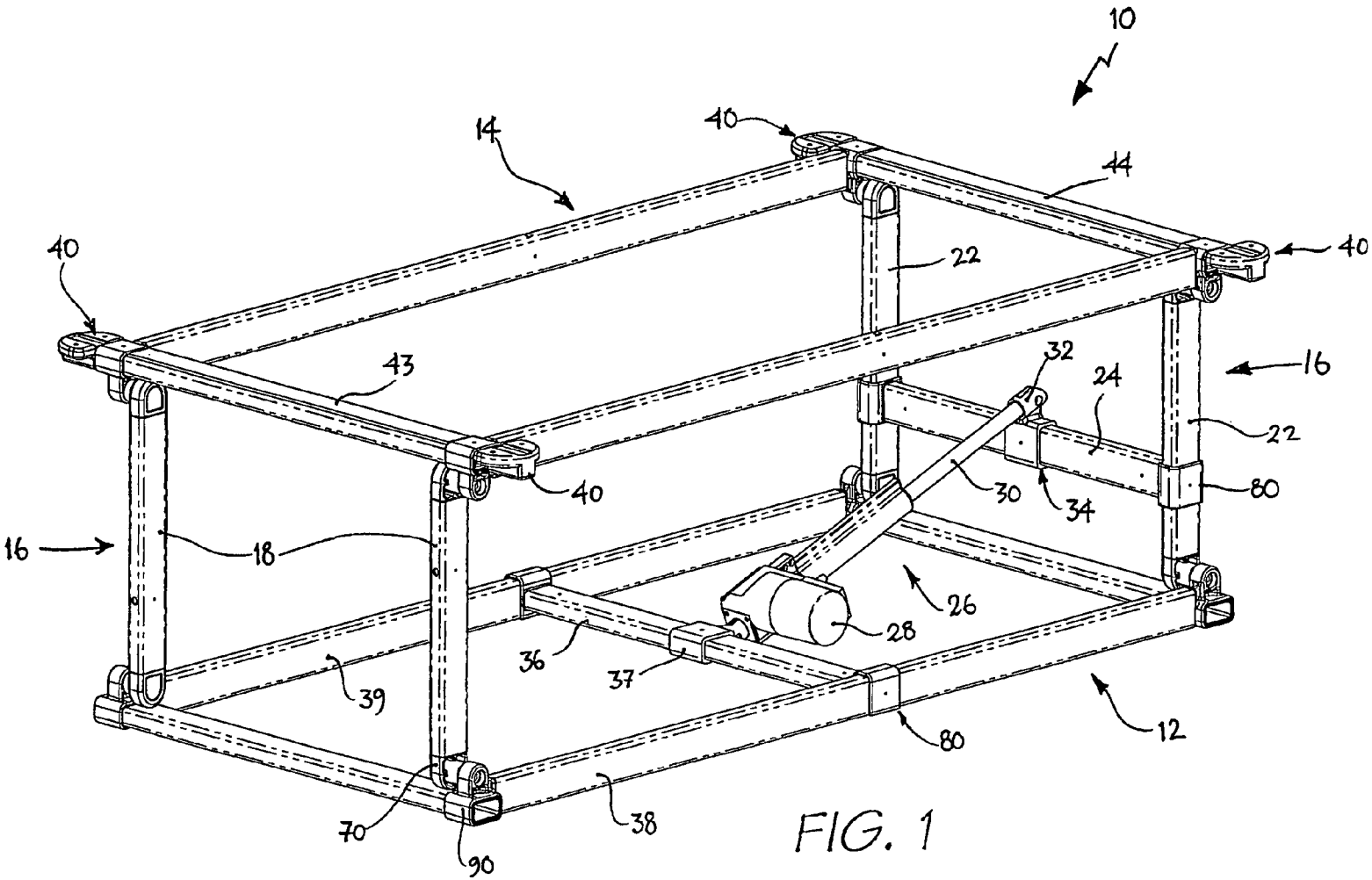
FIG. 1 shows a perspective view of a first embodiment of a bed hoist in an erect configuration.
Figure 2:
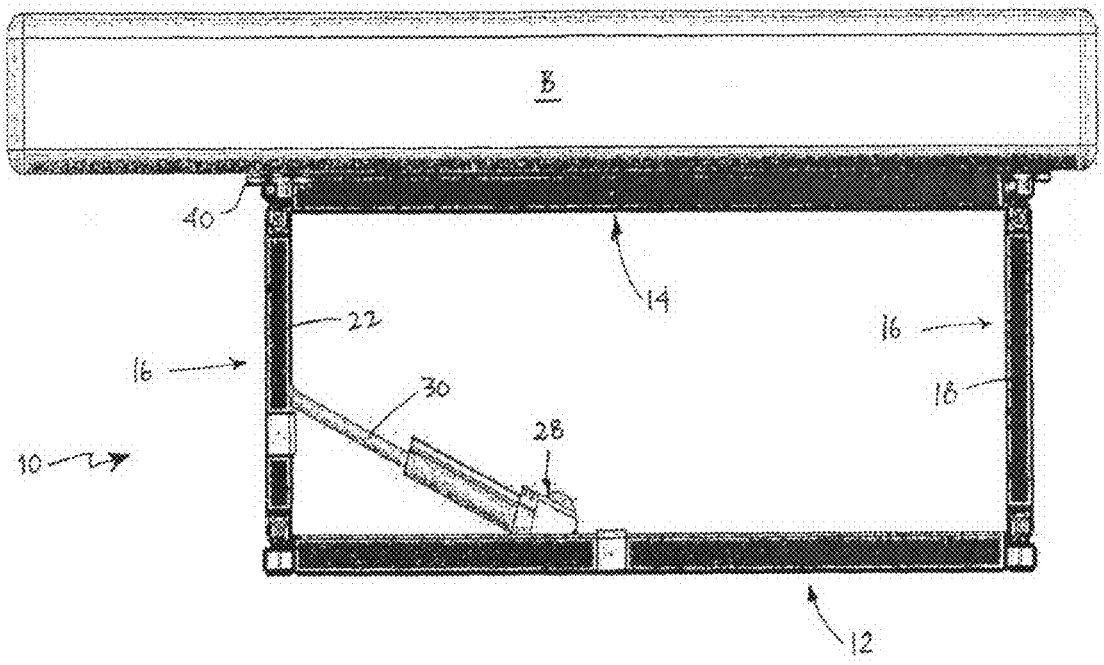
FIG. 2 shows a side view of the bed hoist of FIG. 1 in an erect configuration and supporting a bed base.

Referring firstly to FIGS. 1, 2 and 6 to 10 a bed lifting mechanism in the form of a bed hoist 10 is shown. The hoist 10 can lift a bed base B (FIG. 2) and comprises a base frame 12 for location on a floor F, and a support frame 14 for location at and engagement with an underside of the bed B.

An actuator mechanism is provided for operation between the base frame 12 and support frame 14 to move the support frame away from or towards the base frame and thereby raise or lower the bed. The actuator mechanism comprises a pantographic linkage 16 extending between and pivotally coupled to each of the base and support frames.

The pantographic linkage 16 comprises forward spaced apart linkage arm pairs 18, connected together across the bed hoist by each of the base and support frames. The pantographic linkage 16 also comprises rearward spaced apart linkage arm pairs 22, connected together across the bed hoist by each of the base and support frames, and by a connection bar 24. Each linkage arm in a linkage arm pair 18 and 22 is pivotally coupled at opposite ends to respective pivot points on the base and support frames as shown and as described below.

The pantographic linkage 16 is configured to move the support frame towards or away from the base frame, but also enables lateral shifting of the support frame with respect to the base frame. This enables a bed to moved away from a wall (or the like) to maker for easier making/stripping of the bed.

The pantographic linkage is actuated by a ram unit 26. The ram unit comprises an electric stepper motor 28 and a ram rod 30 (or it may comprise a hydraulic motor or drive). The ram unit is mounted to extend between the base frame and the connection bar 24 that extends between the linkage arm pairs 22. In this regard, a free end 32 of the ram rod 30 is pivotally coupled to a bracket 34 mounted to extend upwardly from the connection bar 24 and located intermediately between the linkage arm pairs 22. At an opposite end of the ram unit the motor 28 is pivotally coupled to a lateral bar 36 via a coupling 37, with the bar 36 extending from and between two opposing and hollow elongate base frame beams 38, 39.

It will seen that each of the support and base frames defines a generally rectangular-shaped frame. The frame members each comprise a plurality of members of elongate hollow section (or channel section), to minimise weight of the bed hoist but to preserve its structural integrity. In the bed hoist embodiment of FIGS. 1, 2 and 6 to 10 the elongate hollow sections are of aluminium for further weight minimisation.

Figure 13:
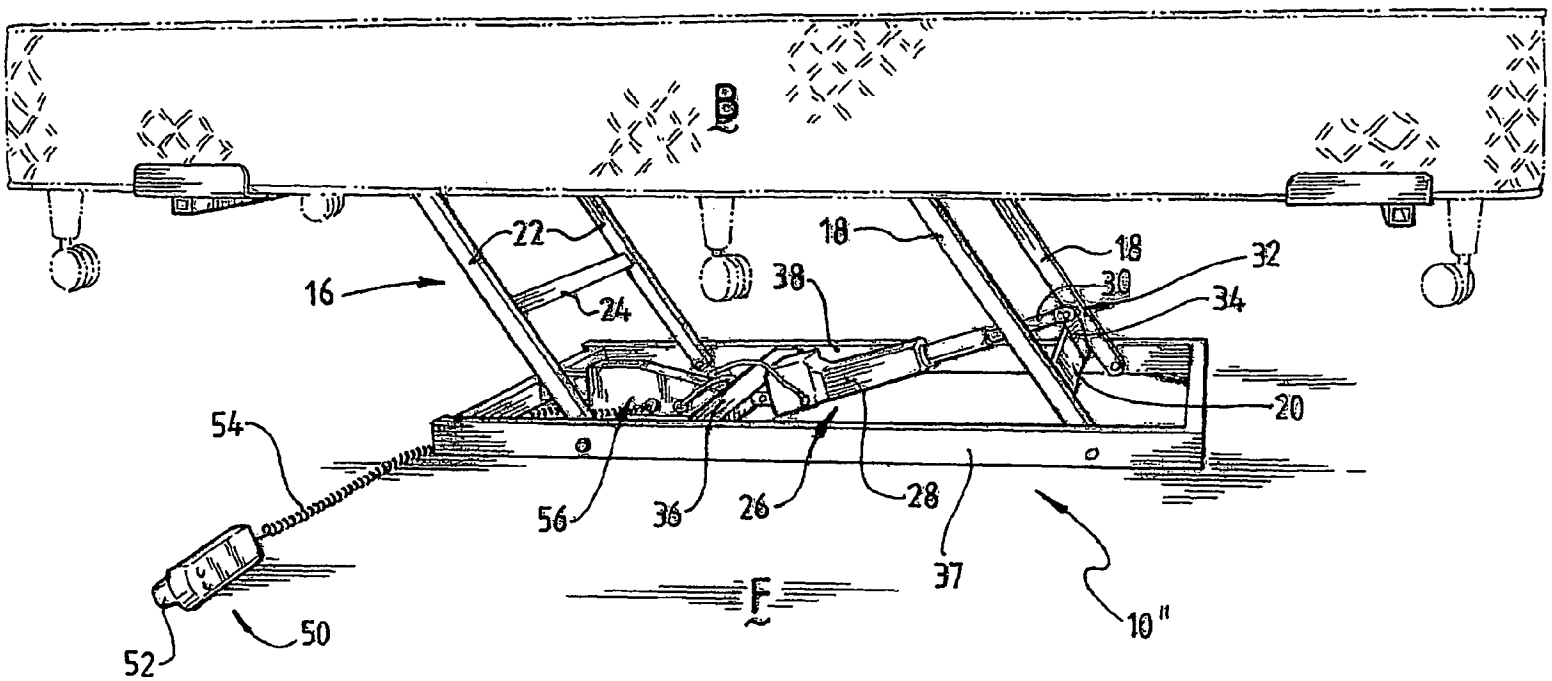
FIG. 13 shows a side perspective view of yet another embodiment of a bed hoist system in a partially erect configuration in use with a bed.
Figure 15:
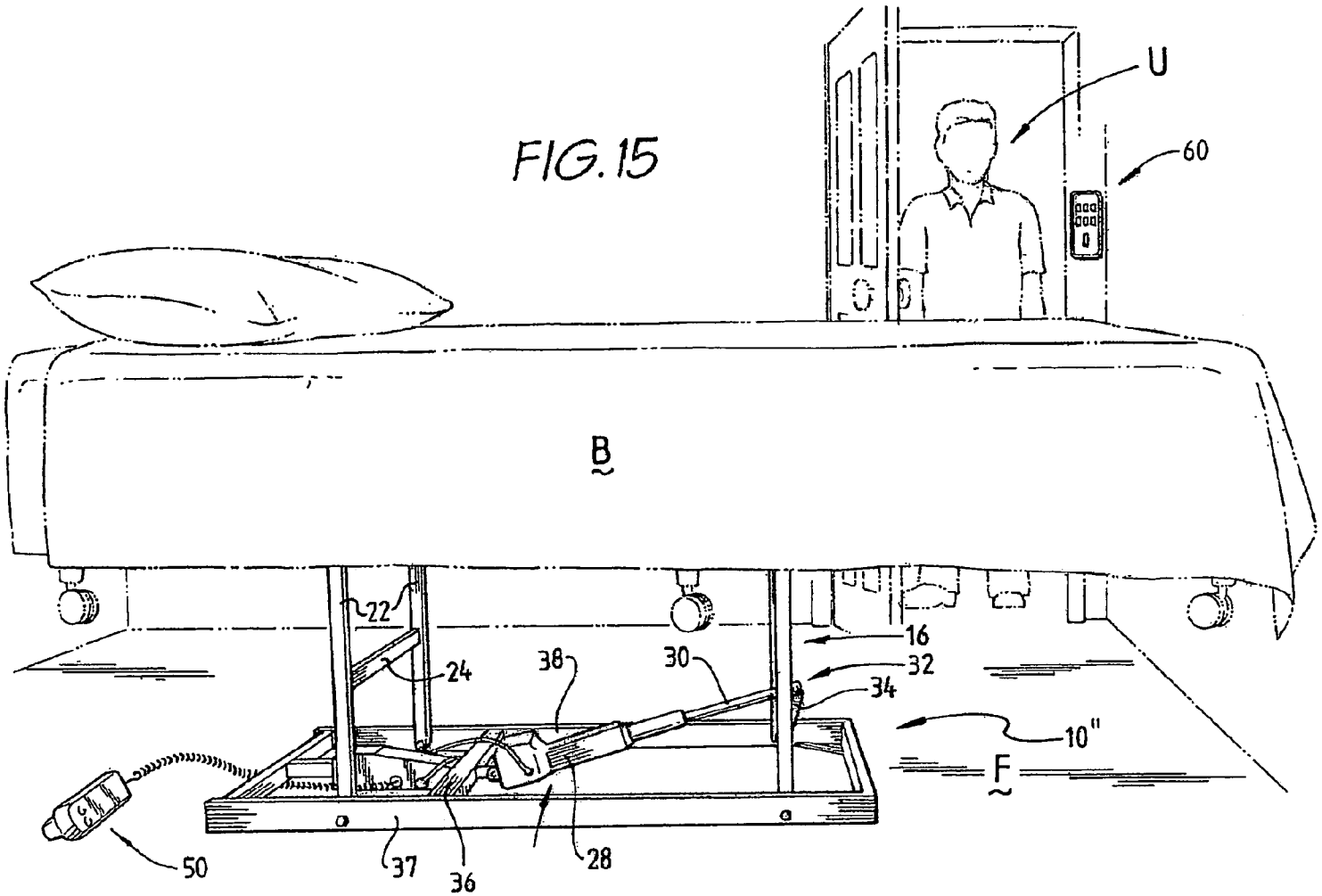
FIG. 15 shows a view similar to FIG. 14, but with the bed made up.

The support and base frames can be provided with a dimension that corresponds to a width and length dimension less than that of the bed to be lifted (see FIGS. 13 & 15). Thus, when the bed is made, and the hoist is collapsed the hoist can be inconspicuously located under a made bed.

The support frame 14 is also provided with four discrete and spaced-apart lands 40 on which the bed underside rests and is supported in use. The lands are located on the end of respective extension arms 42 (FIGS. 8 to 10) which may be adjustably lengthened or shortened, depending on bed width (eg. by the arms telescopically sliding within hollow support frame forward and rearward end members 43, 44.

It should be noted that the bracket 34, coupling 37 and lands 40 can each be moulded (eg. injection moulded from plastic or cast from a light-weight metal) to be lightweight and easily attached to the hoist.

Figure 3:
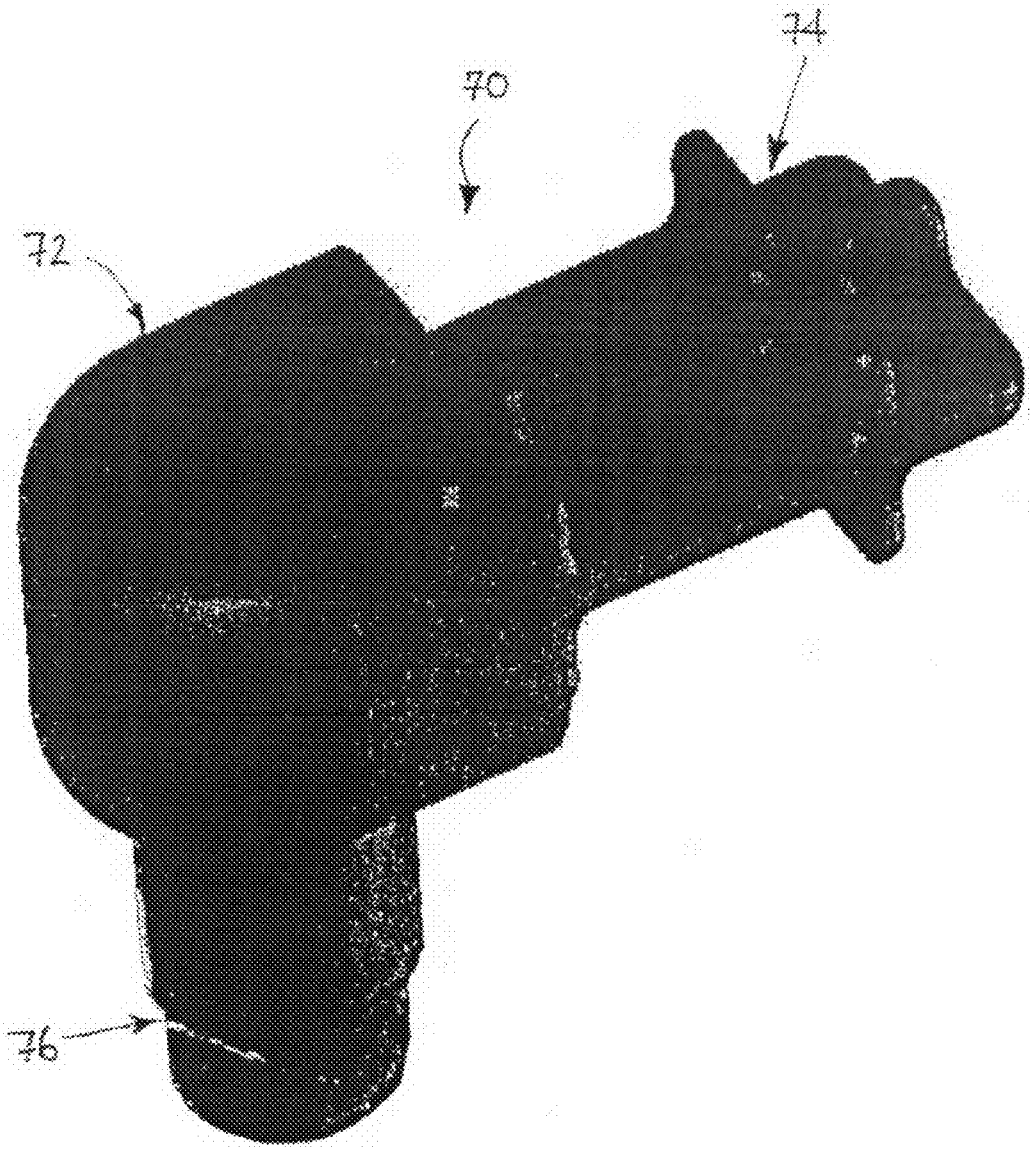
FIGS. 3 to 5 respectively show perspective views of first, second and third connector components for use in the construction of the bed hoist of FIGS. 1 and 2.
Figure 4:
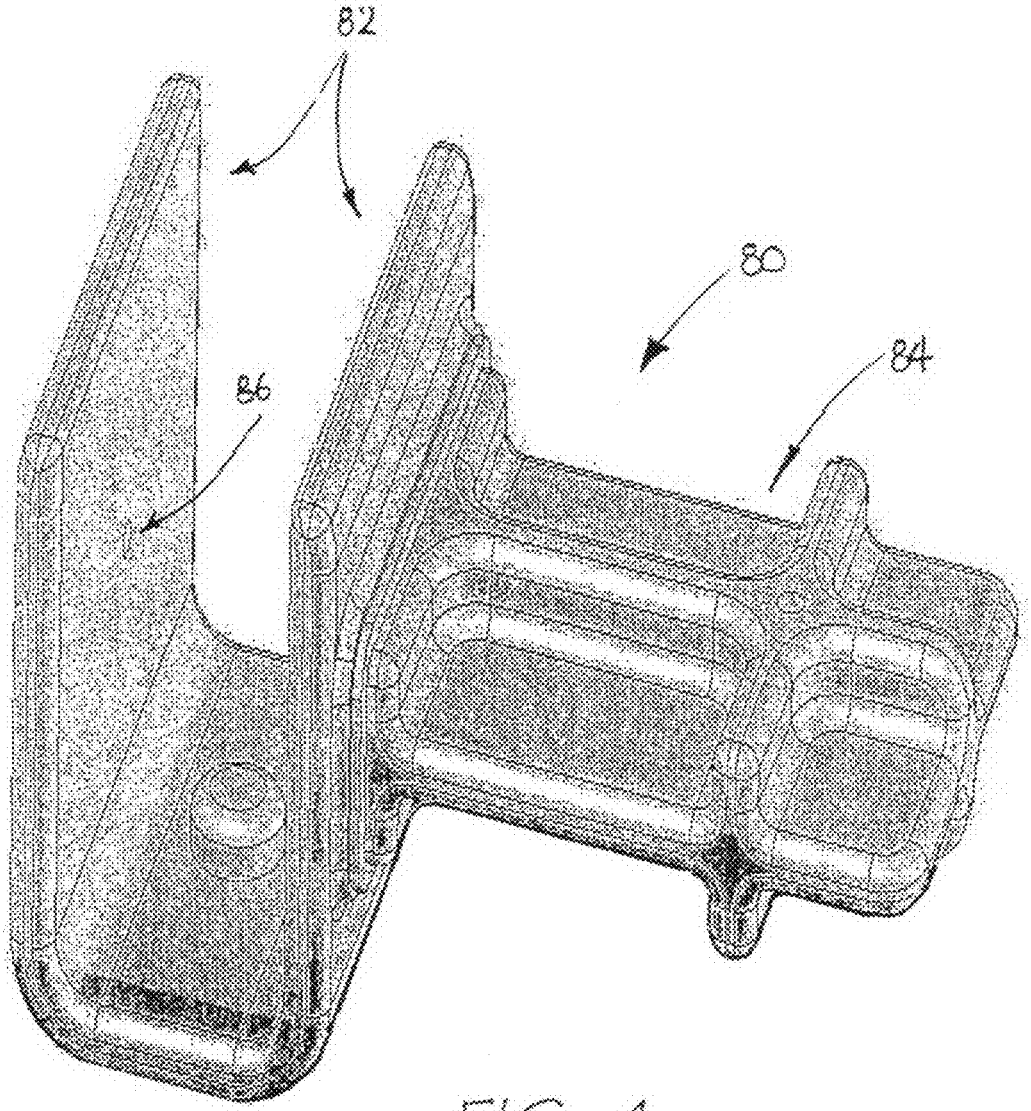
Figure 5:
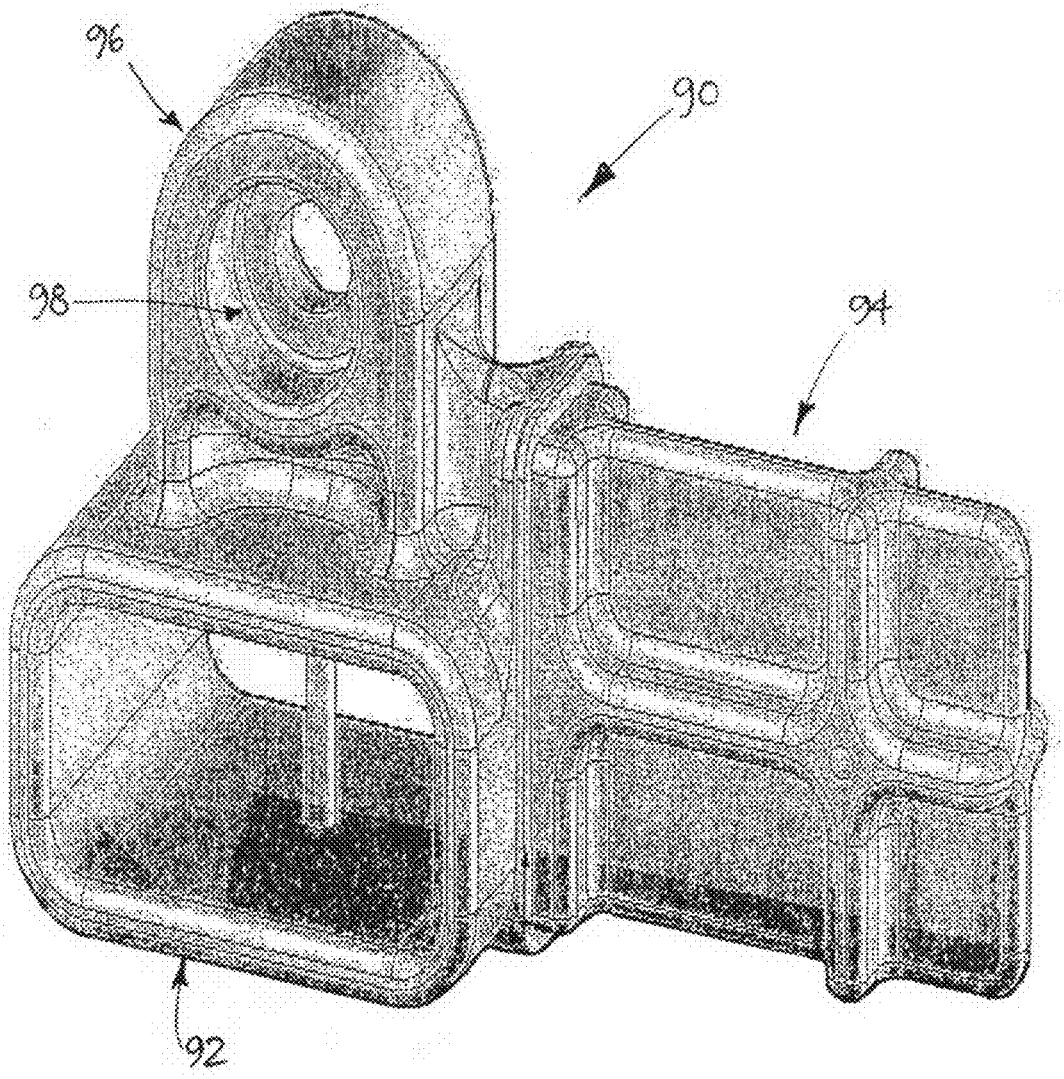

Referring now to FIGS. 3 to 5 first 70, second 80 and third 90 connector components for use in the construction of the bed hoist embodiment of FIGS. 1, 2 and 6 to 10 will now be described. These connectors enable each of the base frame 12, support frame 14 and pantographic linkages 16 to be releasably attached to each other such that the hoist can be supplied as or deconstructed into a kit form.

Supplying the hoist in kit form is of particular commercial benefit, as it enables a commercial establishment (eg. hotel) to purchase multiple mechanisms that then occupy a more confined volume for easy transportation and storage, and which then allow for an easy retrofit to beds when necessary. The connectors also allow for easy servicing and parts replacement.

The releasable attachment is also facilitated by employing hollow or channel elongate members in the frame construction for each of the base frame 12, support frame 14 and pantographic linkages 16. This enables the connectors to be developed and supplied as a push-in type such that they can be urged into or onto respective ends of the hollow elongate members in a friction or interference fit. The connectors may then extend between and connect together the hollow elongate members to define each of the frames and linkages.

Whilst push-in type connectors that result in a friction or interference fit are described, connectors that are screwed, glued or otherwise fastened between members in the frame can alternatively be employed.

For example, referring to FIG. 3, it will be seen that connector 70 can be moulded (eg. injection moulded from plastic or cast from a light-weight metal) to define a body 72. A push-in construction 74 extends from the body 72 and is shaped for friction or interference fit in the end of a respective hollow elongate member for the linkage arm pairs 18 and 22. Also extending from the body 72 orthogonally to the construction 74 is a bearing pin 76, the pin supporting the pivoting of each linkage arm 18 and 22 by pivoting in a respective bearing socket of the connector 90 (FIG. 5).

Referring now to FIG. 4, it will be seen that connector 80 can be moulded (eg. injection moulded from plastic or cast from a light-weight metal) to define a generally U-shaped body 82. A push-in construction 84 extends from the body 82 and is shaped for friction or interference fit in the end of a respective hollow elongate member for the connection arm 24 and the lateral bar 36. The U-shaped body 82 is then adapted for receiving therein (to fit over/around). a respective base frame beam 38, 39 or a linkage arm 22. The respective beam or arm can be fastened to the body 82 by screwing through aperture 86.

Referring now to FIG. 5, it will be seen that connector 90 can also be moulded (eg. injection moulded from plastic or cast from a light-weight metal) to define a body 92. In this case the body is of a hollow construction that is shaped to receive the end members 43, 44 of the support frame 14, and to receive the corresponding end members of the base frame 12 therein, in friction or interference fit. The hollow construction also provides for the slidable extension arms 42 to slide through the body 92.

Again, a push-in construction 94 extends from the body 92 and is shaped for friction or interference fit in the end of respective hollow elongate members 38 and 39 of the base frame 12, and in the end of corresponding hollow elongate members of the support frame 14. Also extending from the body 92 orthogonally to the construction 94 is a bearing socket 96, the socket having a stepped hollow 98 to fixedly support the pivoting of the pin 76 therein during pivoting of the linkage arms 18 and 22.

It will also be seen (see especially FIG. 1) that each linkage arm 18 or 22 is pivotally mounted at a respective end to either the base or support frames via the connector 90, with this connector also interconnecting two of the elongate members in each of the base and support frames respectively. This, and the other connector configurations described, can greatly simplify the construction/dismantling and servicing of the bed hoist (especially when supplied in a kit form for use in a commercial context).

Further, it will also be seen (see especially FIGS. 1, 7C, 9C and 10C) that the connectors 70, 90 are configured to interact such that, as the support frame 14 moves away from or towards the base frame 12, the linkage arms 18, 22 each pivot in a manner whereby they do not align with any elongate member in either the support or base frames. This configuration can eliminate the formation of pinch points in use of the hoist, which can otherwise be dangerous to an unsuspecting user of the hoist.

Figure 11:
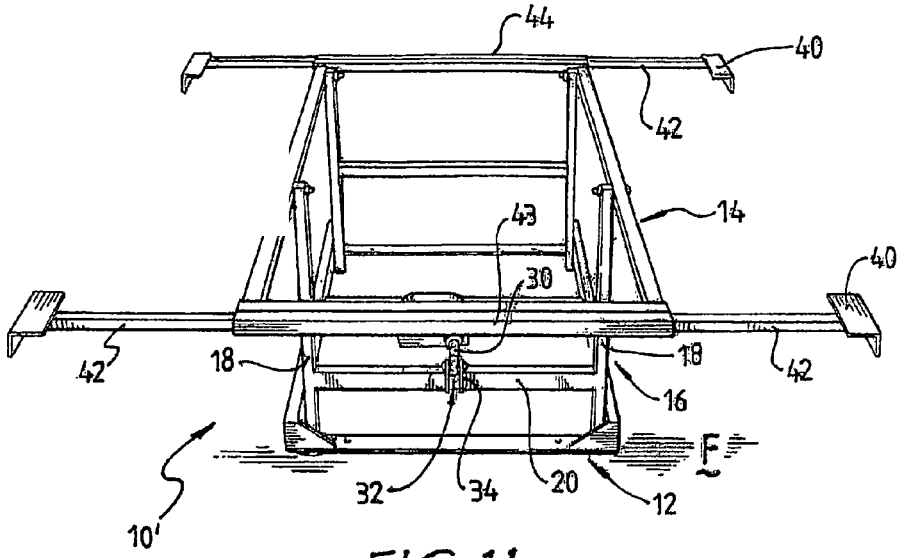
FIG. 11 shows a front perspective view of another embodiment of a bed hoist in an erect configuration.
Figure 12:
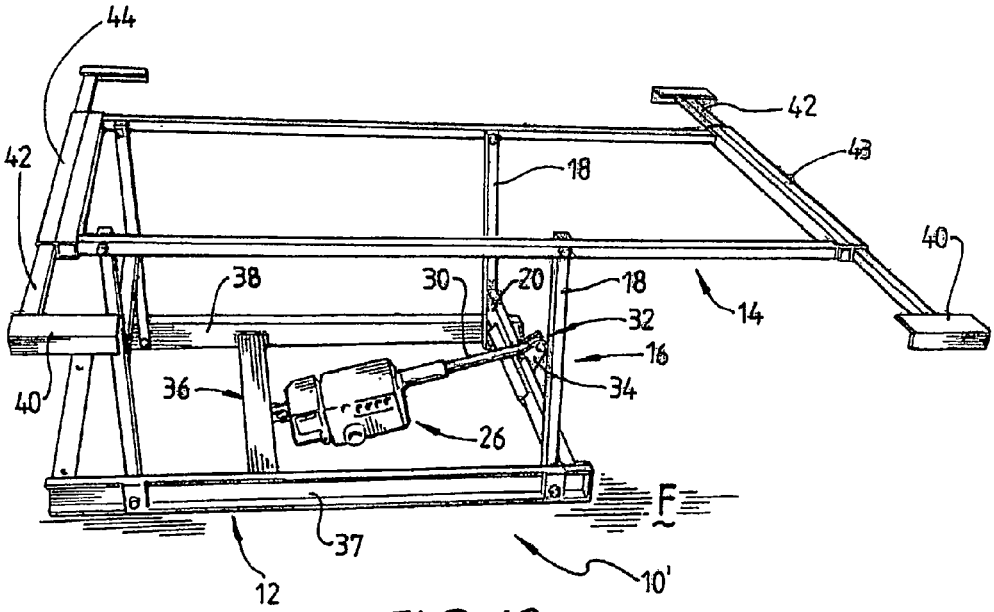
FIG. 12 shows a side perspective view of the bed hoist of FIG. 11 in an erect configuration.

Referring now to FIGS. 11 and 12, where like reference numerals are used to denote similar or like parts, an alternative bed hoist 10' for lifting a bed comprises a base frame 12 for location on a floor F, and a support frame 14 for location at and engagement with an underside of the bed B. This hoist is manufactured from steel components and is welded and bolted together (ie. it does not employ the connectors of the embodiment of FIGS. 1 to 10 for modular (kit) construction). This provides for a heavy duty hoist.

The actuator mechanism is also slightly different in bed hoist 10'. In this regard, the pantographic linkage 16 comprises a connection bar 20 extending between the forward spaced apart linkage arm pairs 18. Also, the ram unit is mounted to extend between the base frame and the connection bar 20 that extends between the forward linkage arm pairs 18.

The lands 40 on which the bed underside rests are also wider than the embodiment of FIGS. 1 to 10. However, in other respects, the operation of the bed hoist 10' is essentially the same as described for hoist 10.

Figure 14:
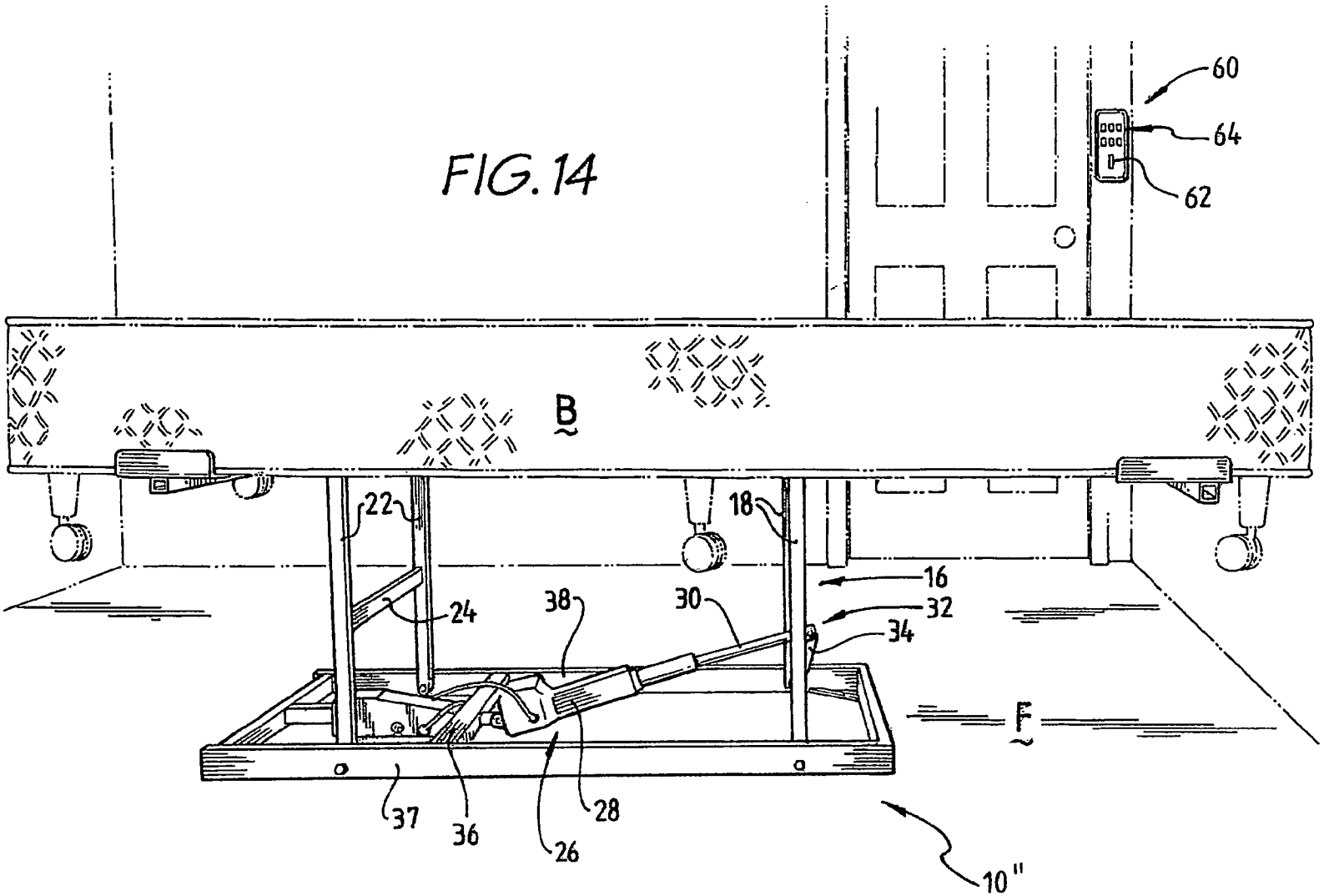
FIG. 14 shows a side perspective view of the bed hoist system of FIG. 13 in an erect configuration.

Referring now to FIGS. 13 to 15, where like reference numerals are used to denote similar or like parts, a bed hoist system is now depicted. The system comprises a bed hoist 10" together with a remote switching unit 50. Switching unit 50 has a switch lever 52 (eg. that can be foot-activated) to selectively activate the bed hoist. In the embodiment of FIG. 13 the switch unit is hard-wired via helical spring cord 54 to a transformer/control unit 56 for the motor 28.

Alternatively, and as shown in FIGS. 14 and 15, the transformer/control unit 56 can be switched on remotely and wirelessly, to selectively activate the bed hoist, via a keypad-type switch unit 60 (or a remote controller). The keypad 60 can be located adjacent to eg. a light-switch at a doorway to a bedroom.

The keypad 60 may comprise a physical key slot 62 and/or alpha/numeric-touch pads 64, which activate the switch when an appropriate activation code is keyed in.

In use, the support frame is positioned in proximity of the bed frame (bed hoist collapsed position), and the bed hoist is positioned under the bed. The actuator mechanism may now be switched on by user U by either foot-activating the switch lever 52, or by activating keypad unit 60 (ie. via the insertion of a physical key in slot 62 or by keying in a code at the touch pads 64). This activates the bed hoist 10".

In this regard, the actuator mechanism causes the pantographic linkage to pivot and to both lift and laterally shift the bed (see sequence of FIGS. 13&14). This lateral shifting brings the bed away from and eg. out of abutment with one or more walls, bed-heads etc, such that a user can then more easily access that side of the bed (eg. and may be able to walk around the bed) allowing for easier and faster bed making.

The bed is generally lifted to a height such that, when making the bed, the user U does not need to bend over, at least to any significant extent. Optimally, the bed hoist is configured to lift the bed to a waist height region of most users. This can help preserve a user's posture and back strength. For example, this can be highly advantageous in a commercial context (eg. in hotels, where service staff must make many beds in a short time).

In alternative arrangements, gas actuated cylinders may be employed in place of the ram unit 26. A ratchet mechanism may also be used to incrementally lock the hoist at a number of different (eg. predetermined) heights. This mechanism can then release by appropriate control (eg. via switching unit 50, keypad unit 60 or a remote controller).

The support frame may for part of the bed framework or be mounted or incorporated into such framework. In other words, a bed can be supplied with a bed hoist (or a part thereof) already attached.

Optimally, the actuator mechanism (and frame) has a very low height in the collapsed configuration (eg. within the range 80-90 mm). This enables it to fit under almost every type of bed.

In a variation, the actuator mechanism may simply comprise a straight lifting mechanism. This may comprise one or more rams (eg. vertically operating), gears etc that are driven by an electrical (eg. stepper) motor or driven hydraulically.

An ideal application of the system is in commercial establishments, such as hotels, motels and the like, where bedding is changed daily.

Whilst specific embodiments of the bed hoist and bed hoist system have been described it should be appreciated that the bed hoist and system can be embodied in many other forms.

The invention claimed is:

1. A bed lifting system for lifting a bed, the system comprising:

a portable bed lifting mechanism that is separate from and positionable under a base of the bed when the base is located on a floor, wherein the bed lifting mechanism comprises:

a base for location on the floor;

a support for location at and engagement with an underside of the bed base, wherein the support is provided with a plurality of discrete and spaced-apart lands on which the underside of the bed base can rest and be supported in use, wherein the position of the lands is adjustable, and wherein each land is connected to a respective arm that is slidably mounted with respect to the support for lateral movement with respect to the support; and an actuator for operation between the base and support to move the support away from or towards the base and thereby raise or lower the bed; and a switch remotely located from the bed lifting mechanism, the switch being adapted to enable selective and remote actuation of the bed lifting mechanism.

2. A bed lifting system as claimed in claim 1 wherein the switch forms part of a switch unit comprising at least one of:

a keypad that is positionable on a wall of a room in which the bed to be lifted is located; and a hand-held remote controller that can be accessed on entry to a room in which the bed to the lifted is located.

3. A bed lifting system as claimed in claim 2 wherein a user may enter a room, engage the switch unit, cause the bed to be lifted, access the bed, and thereafter the user can re-engage the key pad or controller to lower the bed.

4. A bed lifting system as claimed in claim 2 or 3 wherein the keypad is key-activated with at least one of a physical key and a touch pad, together with an activation code, to activate the keypad, to thus selectively actuate the bed lifting mechanism.

5. A bed lifting system as claimed in claim 1 wherein the actuator comprises a pantographic linkage extending between and pivotally coupled to each of the base and support for moving the support towards or away from the base, but also so as to enable lateral shifting of the support with respect to the base.

6. A bed lifting system as claimed in claim 5 wherein the pantographic linkage is actuated to be moved by a ram.

7. A bed lifting system as claimed in claim 6 wherein the ram is driven by a motor selected from the group consisting of an electrical motor and a hydraulic motor.

8. A bed lifting system as claimed in claim 7 wherein the electrical motor is a stepper motor.

9. A bed lifting device as claimed in claim 6 wherein the ram and a ram drive are mounted to extend between the base and one or more links in the pantographic linkage.

10. A bed lifting system as claimed in claim 6 wherein a free end of the ram is pivotally coupled to a member that laterally extends from and between two opposing linkage arms of the pantographic linkage of the actuator and, at an opposite end of the ram there is provided a pivotal coupling to a lateral member that extends from and between two opposing frame members of the base.

11. A bed lifting system as claimed in claim 1 wherein each of the support and base comprises a rectangular frame having a dimension that corresponds to a width and length dimension less than that of the bed to be lifted.

12. A bed lifting system as claimed in claim 11 wherein the frames each comprise a plurality of members of hollow or channel section.

13. A bed lifting system as claimed in claim 1 that is configured such that, during bed raising, the bed is also lifted laterally away from and out of abutment with one or more walls (or other surfaces) such that a user may then be able to access that side of the bed.

14. A bed lifting system as claimed in claim 1 that lifts the bed to a height such that, when making the bed, a user does not need to bend over, at least to any significant extent.

15. A bed lifting system as claimed in claim 1 that is configured to lift the bed to a waist height of most average users.

16. A bed lifting mechanism comprising:

a base for location on a floor;

a support for location at an engagement with an underside of the bed; and an actuator for operation between the base and support to move the support away from or towards the base and thereby raise or lower the bed;

wherein the support is provided with a plurality of discrete and spaced-apart lands on which the bed underside can rest and be supported in use, with the position of each land being adjustable, and wherein each land is connected to a respective arm that is slidably mounted with respect to the support for lateral movement with respect to the support.

17. A bed lifting mechanism as claimed in claim 16 wherein the actuator comprises a pantographic linkage extending between and pivotally coupled to each of the base and support for moving the support towards or away from the base, but also so as to enable lateral shifting of the support with respect to the base.

* * * * *